United States Patent [19]

Bührer

[11] 4,241,778

[45] Dec. 30, 1980

[54] METHOD AND APPARATUS FOR THE REMOVAL OF SAND BALES CONTAINING CASTINGS FROM MOLDING BOXES OF POURED FOUNDRY MOLDS

[76] Inventor: Erwin Bührer, Vögelingässchen 40, 8200 Schaffhausen, Switzerland

[21] Appl. No.: 973,027

[22] Filed: Dec. 26, 1978

[30] Foreign Application Priority Data

Dec. 27, 1977 [CH] Switzerland ..... 16036/77

[51] Int. Cl.[3] ..... B22D 29/02

[52] U.S. Cl. ..... 164/131; 164/344; 164/404; 164/189; 164/223

[58] Field of Search ..... 164/131, 132, 404, 344, 164/189, 223, 407, 345-347, 213; 264/334

[56] References Cited

U.S. PATENT DOCUMENTS

| | | | |
|---|---|---|---|
| 1,329,425 | 2/1920 | Miller | 164/223 |
| 3,572,625 | 3/1971 | Williamsen | 164/131 |
| 3,736,978 | 6/1973 | Taccone | 164/213 |

*Primary Examiner*—Robert D. Baldwin

*Assistant Examiner*—K. Y. Lin

*Attorney, Agent, or Firm*—Toren, McGeady and Stanger

[57] ABSTRACT

Sand bales containing castings are removed from poured foundry molds by clamping together in a horizontal position the molding boxes containing the sand bales, by supporting the sand bales from below independently of the molding boxes, and by applying to the molding boxes jarring or accelerative forces acting in a vertical direction with a magnitude exceeding the static frictional forces which exist between the sand bales and the molding boxes, with these forces being applied while the sand bales are supported thereby to cause the sand bales to move out of the molding boxes. In one aspect, the sand bales are supported from below by a force lower than the weight of the bales thereby to permit the bales to drop out of the molding boxes while the accelerative forces are applied to the molding boxes in an upward direction. Conversely, the sand bales may be lifted upwardly out of the molding boxes with accelerative forces being applied to the molding boxes in a downward direction.

10 Claims, 5 Drawing Figures

METHOD AND APPARATUS FOR THE REMOVAL OF SAND BALES CONTAINING CASTINGS FROM MOLDING BOXES OF POURED FOUNDRY MOLDS

BACKGROUND OF THE INVENTION

The present invention relates generally to foundry molding and more particularly to a method and apparatus for the removal of sand bales containing castings from molding boxes of poured foundry molds.

In order to better utilize their molding surfaces, foundry molds which are made of clay-bonded molding sand are usually compacted in molding boxes and they are poured in the form of upper and lower halves combined to form a complete foundry mold. The use of such molding boxes becomes inevitable when the foundry mold exceeds a certain size. Since high-pressure compacting of foundry molds is utilized with greater frequency, and since, as a result, the forces acting on the inner surfaces of the molding boxes during compacting of the molding sand become larger, the molding boxes must be made with a stiffer construction. As a result, the cost of the molding boxes is increased.

The physical values or characteristics of finished castings will usually depend on the cooling time. Furthermore, it is usually required that castings have a residual stress which is as small as possible after cooling. Accordingly, it is desirable that castings cool slowly after pouring, sometimes for up to one hour or more while remaining in the molding sand.

The aforementioned requirements tend to cause an increase in the costs incurred for the molding boxes not only in respect to the plant involved but also with regard to the costs of operation, and this is no longer economically acceptable. Therefore, devices are known in which the sand bales containing the castings are removed from the molding boxes as soon as the castings have a temperature which is safely below the eutectoid temperature.

Such known devices for removing sand bales from the molding boxes may comprise a punch or die which interacts with a support, wherein the molding boxes rest on the support and the punch pushes the sand bales out of the molding halves. However, these devices have the disadvantage that very high forces of the die are required to remove the sand bales. Aside from the cumbersome construction which is required for applying these forces, such die forces also give rise to the danger that the castings which are sensitive to deformation may be damaged.

According, it is the intent of the present invention to provide means for the separation from the molding boxes of the sand bales within which the castings are contained while avoiding forces which may deform the sand bales.

SUMMARY OF THE INVENTION

In accordance with the method of the present invention, the molding boxes containing the sand bales are clamped together in a horizontal position, the sand bales are supported from below for at least a portion of their weight independently from the molding boxes, and vertically directed accelerative forces, which act temporarily and which exceed the static friction of the sand bale in the molding box, are applied to the molding box while the support of the sand bales is maintained in order to move the sand bales out of the molding boxes.

The application of the accelerative forces to the molding box has the surprising result that the sand bales are separated from the molding box as a whole. That is, the sand bales remain completely intact and are also removed in the corner regions. This means that cleaning of the molding boxes which was heretofore necessary, now becomes unnecessary.

When the accelerative forces are introduced against the direction in which the sand bales are to be moved out of the molding box, under such circumstance there is only required for support of the sand bale a force which corresponds in its order of magnitude to the weight of the sand bale. Accordingly, if the sand bale is, for example, to be moved upwardly out of the mold box, the supporting force which is applied thereto must only be at most two or three times as large as the weight of the sand bale.

In accordance with a further embodiment of the method of the invention, it is possible to utilize a supporting force which is smaller than the weight of the sand bale and to direct the accelerative forces upwardly whereby the sand bale is moved downwardly out of the mold box. However, the preferred embodiment of the inventive method is that wherein the supporting force is selected larger than the weight of the sand bale and the accelerative forces are directed downwardly. As a result of this embodiment, the sand bale is moved upwardly out of the mold boxes, and this simplifies the delivery of the mold boxes to an unpacking station through another cooling device.

Apparatus in accordance with the invention for carrying out the method comprises a horizontal support for the molding boxes as well as a horizontal plate which is arranged beneath the support for the molding boxes and is vertically movably driven by a cylinder-piston arrangement. A plurality of stop members which also support the molding boxes are arranged and distributed in a particular manner, and means for clamping the molding boxes together are provided. A plurality of compressed air hammers are connected to the stop members in a positive manner and they are held so as to be directed toward the support plane. By means of these compressed air hammers it is possible to temporarily apply in quick succession very high accelerative forces which act directly upon the clamped molding boxes so that large reaction forces, which would ordinarily require that they be absorbed by massive structural components, are not generated.

In accordance with a preferred embodiment of the invention, the clamping means of the apparatus are constructed as cylinder-piston arrangements resiliently connecting the stop members to the compressed air hammers which are rigidly connected to each other. As a result, it is possible to press the molding boxes onto the support by means of the same members which clamp the molding boxes together. This is especially advantageous when the stop members are directed downwardly. According to an advantageous further development of the invention, the stop members or the compressed air hammers are rigidly connected on a support structure which forms a guide for a vertically movable frame on which the compressed air hammers or the stops are mounted. Accordingly, if the compressed air hammers are, for example, immediately connected to the support structure, the vertically movable frame carries the stop members.

A pneumatic cylinder-piston arrangement is preferably provided as a resilient connection between the stop members and the compressed air hammers so that an intermediate arrangement of special spring elements is not necessary.

According to another preferred embodiment of the invention, the stop members are elastically deformable and they are, for example, provided with intermediate layers. As a result, the noise level of the apparatus is decisively reduced. A similar effect is achieved by another preferred measure which provides that each of the compressed air hammers comprises an anvil of a material such as, for example, reinforced plastic material, which requires significant energy to undergo elastic deformation.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
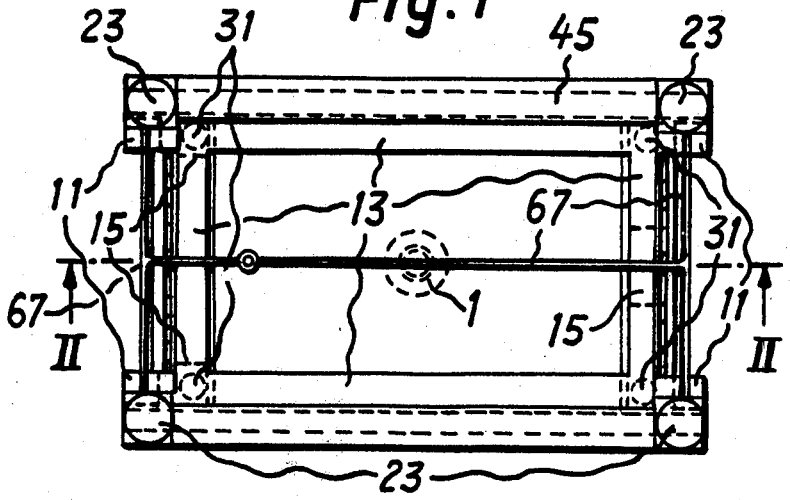
FIG. 1 is a plan view of a first embodiment of the invention.

Referring to the drawings, the invention is depicted in FIGS. 1 to 3 and 5, as comprising a lifting cylinder 1 which is supported on the ground 2. In the lifting cylinder 1, a piston rod 3 which carries a table 5 can be lowered from a raised position 7 into a position 9. Four columns 11 are connected to each other through horizontal girders 13. At the bottom side of the horizontal girders 13 there are provided three stop members 15 in a triangular arrangement. Each of the three stops 15 consists of two plates 17 and 19 and of an intermediate rubber layer 21. At four corners, as seen in FIG. 1, the girders 13 support four cylinders 23 on whose piston rods 25 there is mounted a frame 27. The frame 27 can be raised and lowered between the positions 71 and 72 (FIG. 3) and it is horizontally guided on all sides in the columns 11. The frame 27 furthermore has four bores 29 (FIG. 5) in which there are arranged compressed air hammers 31 which are fastened by means of screw bolts 33. The compressed air hammers 31 which are equipped with known valve controls have a percussion piston 35 which can be moved within a bore 37 from a position 39 into a position 41. In the position 41, the percussion piston 35 strikes an anvil 43. While the percussion piston 35 is made of steel, the anvil 43 is preferably constructed of reinforced plastic material which is capable of absorbing exceptionally high energy forces for elastic deformation.

A roller conveyor 55 delivers poured foundry molds to the apparatus. An arriving foundry mold 45 which consists of a lower part 47 and an upper part 49 of the molding box and a sand bale 51 which surrounds the castings 53, can be moved on a roller conveyor 55 which extends through the apparatus from a position 57 into a position 59 above the lowered frame 27.

Figure 2:
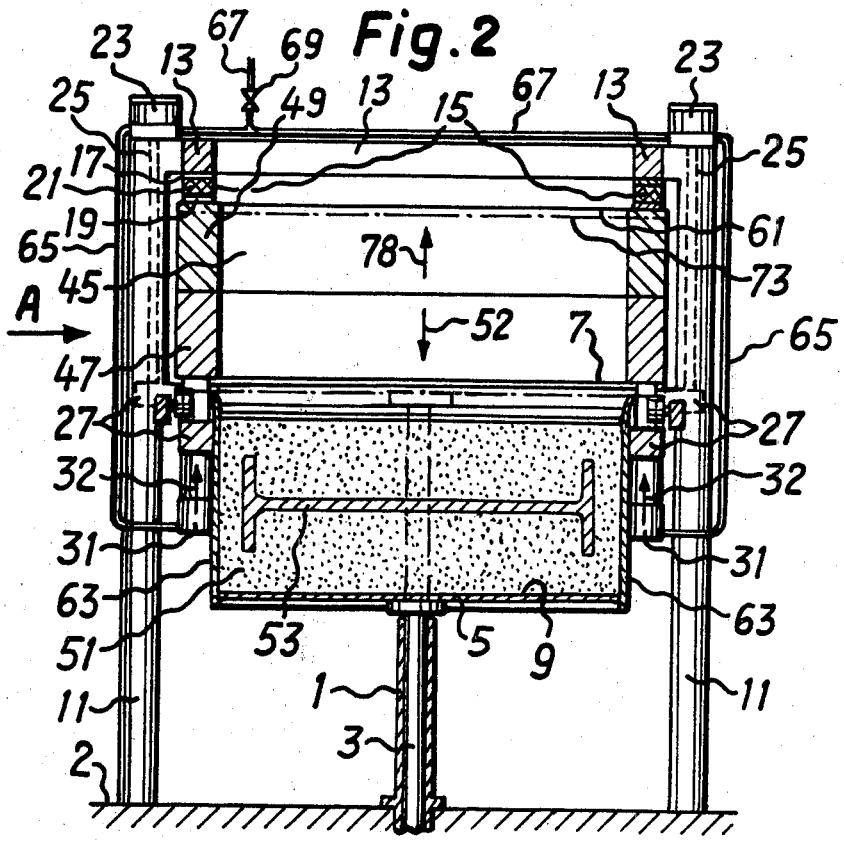
FIG. 2 is a vertical section taken along the line II—II of FIG. 1.
Figure 3:
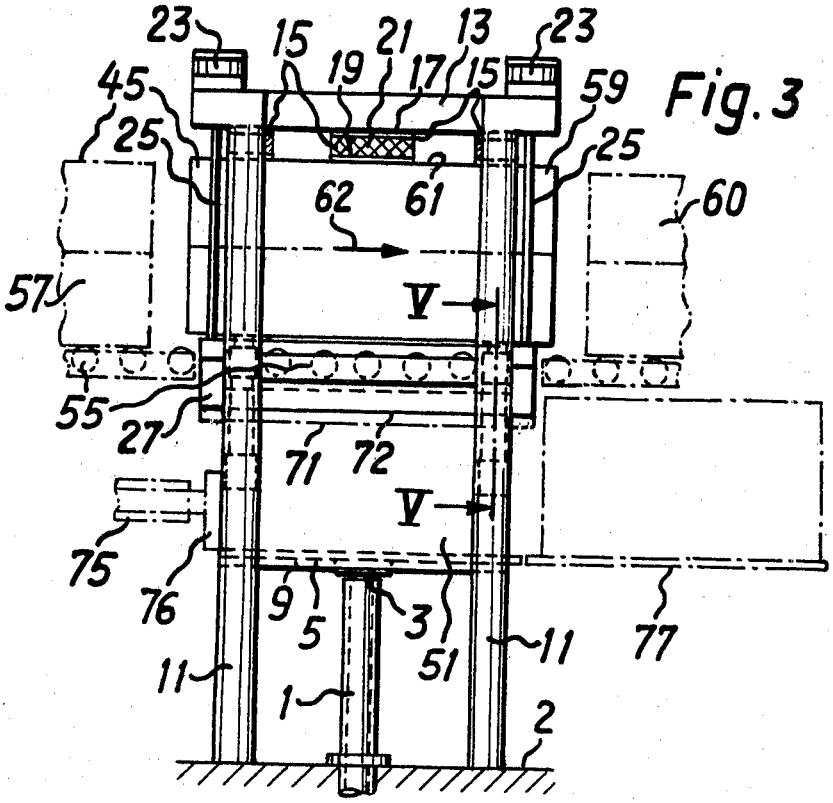
FIG. 3 is a view of FIG. 2 in the direction of arrow A.

In the operation of the apparatus shown in FIGS. 1–3 and 5, starting from the positions of the parts as shown in FIGS. 2 and 3 in which the sand bales have been previously removed, the molding boxes 47 and 49 of a foundry mold are in the raised position 61. In this position, the cylinders 23 clamp the lower part 47 against the upper part 49 of the molding box through the piston rods 25, the frame 27 and the compressed air hammers 31. The upper part 49 of the molding box, in turn, rests against the stop members 15. The cylinders 23 receive compressed air during operation through the joint supply line 67 and the opened valve 69. Since the compressed air hammers 31 are connected to the cylinders 23 through the line 65, the cylinders 23 are out of operation when the valve 69 is closed. Furthermore, the sand bale 51 including the casting 53 which has just been removed rests on the table 5 which has reached the lowered position 9. Side plates mounted on the frame 27 form the boundary of the sand bale 51 and prevent rotation of the table 5.

By reversing the valve 69 to exhaust, the clamping of the molding boxes is eliminated and the frame 27 is lowered from the position 72 into the position 71 and the molding boxes 47,49 are lowered from the position 73 onto the roller conveyor 55. Simultaneously, the supply line of the cylinder 75 is reversed, and the pressure plate 76 pushes the sand bale 51 including the casting 53 from the table 5 onto a movable support 77 outside of the device. Subsequently, the supply line of the cylinder 75 is once again reversed and the pressure plate 76 is again moved back into the orginal position. By reversing the lifting cylinder 1, the table 5 is raised from the position 9 into the position 7. Simultaneously, the foundry mold 45 which is in the position 57 and the molding boxes 47,49 which are in the positions 59 and 60 are moved ahead by one spacing in the direction of arrow 62. The cylinders 23 receive compressed air by reversing the valve 69 and the foundry molds 45 are lifted into the position 61 through the frame 27 and the compressed air hammers 31. As a result, the molding boxes 47 and 49 are clamped together with the molding box 49 resting against the stop member 15. When the foundry mold 45 is lifted from the roller conveyor 55, the pressure in the cylinders 23 rises thus automatically actuating the compressed air hammers 31. The percussive blows which are applied by the percussion piston 35 striking the anvil 43 act upwardly in a vertical direction and are transmitted in the corners (FIG. 1) onto the molding box 47. As a result, the molding boxes 47, 49 are subjected to very high accelerations which act temporarily and in quick succession. These accelerations significantly exceed the static frictional forces between the sand bale and the walls of the molding box. As a result, the molding boxes 47 and 49 are separated from the sand bale. No forces of any significance are transmitted to the sand bale itself, and thus the sand bale remains intact.

The sand bale 51 has the tendency to move downwardly relative to the molding boxes. Since the lifting force of the cylinder 1 is dimensioned to support only a portion of the weight of the sand bale 51 and the castings 53, the table including the sand bale 51 moves downwardly in the direction of the arrow 52 in order to finally reach the position 9. Since the elastic intermediate rubber layers 21 allow vertical movements of the molding boxes 47 and 49 under the influence of accelerative forces exerted by compressed air hammers 31, the separation of the molding boxes from the sand bale is facilitated. The transmission of the clamping forces onto the girders 13 takes place without noise.

Figure 4:
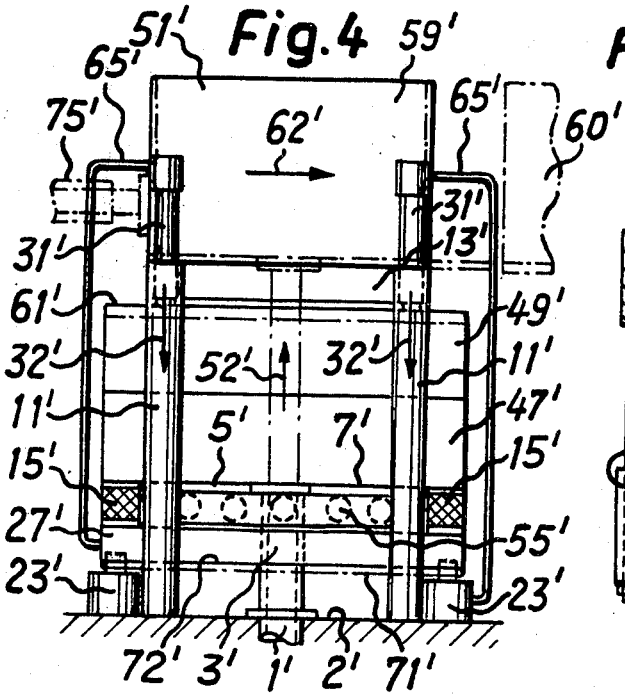
FIG. 4 is a view of another embodiment taken in a direction comparable to that of FIG. 3.
Figure 5:
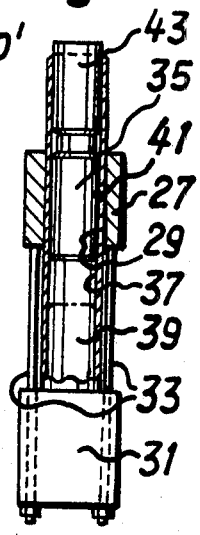
FIG. 5 is a view of a compressed air hammer partially in section taken along the line V—V of FIG. 3, and illustrated in an enlarged scale.

While FIGS. 1 to 3 and 5 show an apparatus, in which the sand bale 51 is lowered for removal out of the molding box, and in which the compressed air hammers 31 act upwardly in the direction of arrow 32, FIG. 4 shows an alternative embodiment in which the sand bale is lifted upwardly out of the molding box and wherein the compressed air hammers act vertically downwardly.

The embodiment of the apparatus shown in FIG. 4 is constructed of elements which, at least functionally, correspond to the elements of the previously described embodiment. Therefore, the reference numerals used in FIG. 4 differ from those previously used in that they are primed. In respect to the arrangement of the elements, the embodiment according to FIG. 4 primarily differs in that the cylinders 23' are immediately supported on the ground 2'. Also in this case, four cylinders 23' are provided. The cylinders 23' act with their pistons directly on the corners of the frame 27' which is arranged above the cylinders 23'. Accordingly, the roller conveyor 55' which delivers the poured foundry molds to the apparatus and removes the empty molding boxes may be arranged on a lower plane than in the previously described embodiment. The frame 27', which is again guided between the columns 11' so as to be vertically movable, is in its raised position as indicated by position 72' shown in solid lines; the lowered position is shown at 71' by dash-dot lines. The stop members 15' are mounted on the upper side of the frame 27' so that the molding boxes 47', 49' are supported by these stop members.

The compressed air hammers 31' which act downwardly in the direction of arrow 32' are mounted at the girders 13 instead of at the frame. They may be mounted in a manner similar to the one shown in FIG. 5. In the position of the molding boxes 47',49', shown in solid lines, the latter is pressed with its upper side against the compressed air hammers 31'. In the position shown in FIG. 4, the lifting cylinder 1' has lifted the sand bale 51' out of the molding boxes 47', 49' into the position 59' through its piston rod 3' and the table 5'. In this position, the sand bale 51' can be pushed into the position 60' in the direction of arrow 62' by actuating the cylinder 75'.

The inventive apparatus makes it possible to separate molding boxes of a poured foundry mold from the sand bales which surround the castings without damaging the castings, even when the castings are fragile and in an initially-hardened state. This is also true when the castings are spaced the smallest possible distance from the inner wall of the molding box.

While specific embodiments of the invention have been shown and described in detail to illustrate the application of the inventive principles, it will be understood that the invention may be embodied otherwise without departing from such principles.

What is claimed is:

1. A method for removing sand bales containing castings from molding boxes of poured foundry molds comprising the steps of: clamping said molding boxes together in a horizontal position; supporting said sand bales from below with a predetermined supporting force independently of said molding boxes, said predetermined supporting force being provided for at least a portion of the weight of said sand bales; applying to said molding boxes in a direction generally aligned with the walls thereof accelerative forces acting in a vertical direction while maintaining said supporting force for said sand bales, said accelerative forces being applied temporarily in a direction only which is opposite to a force resulting from the weight of said sand bales and said predetermined supporting force and being of a magnitude exceeding the magnitude of static frictional forces between said sand bales and said molding boxes in order to cause said sand bales to move out of said molding boxes; and removing said sand bales from said molding boxes.

2. A method according to claim 1 wherein said supporting of said sand bales is accomplished by a force smaller than the weight of said sand bales and wherein said accelerative forces are directed upwardly.

3. A method according to claim 1 wherein said support of said sand bales is accomplished by a force larger than the weight of said sand bales and wherein said accelerative forces are directed downwardly.

4. Apparatus for removing sand bales containing castings from molding boxes of poured foundry molds comprising: means for clamping said molding boxes together in a horizontal position so that the walls thereof are situated in generally vertical planes; means for supporting said sand bales from below independently of said molding boxes, said support means being vertically movable in a predetermined direction and operating to provide support for at least a portion of the weight of said sand bales; and means vertically aligned with the walls of said mold boxes for applying to said molding boxes in a vertical direction temporarily acting accelerative forces of a magnitude exceeding static frictional forces between said sand bales and said molding boxes while said sand bales are being supported by said supporting means to cause said sand bales to move out of said molding boxes, said means for applying said accelerative forces being operable in one direction only which is opposite to said predetermined direction of said support means.

5. Apparatus according to claim 4 wherein said means for supporting said sand bales comprise a horizontal plate and a piston-cylinder mechanism to effect vertical driving movement of said plate, and wherein said means for applying said accelerative forces comprise a horizontal support device for said molding boxes, a plurality of stop members arranged in a distributed manner for engaging said molding boxes, said means for clamping said molding boxes together, and a plurality of compressed air hammers operatively associated with said stop members.

6. Apparatus according to claim 5 wherein said clamping means comprise piston-cylinder means arranged to resiliently interconnect said stop members with said compressed air hammers which are rigidly connected to each other.

7. Apparatus according to claim 6 wherein one of said stop members and said compressed air hammers are rigidly mounted on a support structure forming a guide for a vertically movable frame upon which there are mounted the other of said stop members and said compressed air hammers.

8. Apparatus according to claim 6 wherein said cylinder-piston means comprise a pneumatic cylinder-piston mechanism.

9. Apparatus according to claim 6 wherein said stop members are constructed to be resiliently deformable.

10. Apparatus according to claim 5 wherein each of said compressed air hammers comprises an anvil formed of material exhibiting high elastic deformation capabilities.

* * * * *